United States Patent [19]

Cattaneo

[11] Patent Number: 4,936,534

[45] Date of Patent: Jun. 26, 1990

[54] SYSTEM FOR WALL MOUNTING A CANTILEVERING PIECE OF FURNITURE

[75] Inventor: Carlo Cattaneo, Figino Serenza, Italy

[73] Assignee: Camar S.p.A., Como, Italy

[21] Appl. No.: 340,859

[22] Filed: Apr. 20, 1989

[30] Foreign Application Priority Data

May 20, 1988 [IT] Italy ..... 20654

[51] Int. Cl.[5] ..... A47B 96/06

[52] U.S. Cl. ..... 248/225.1; 24/592; 312/245

[58] Field of Search ..... 248/551, 220.2, 222.1, 248/222.2, 225.1; 403/255, 254, 406.1, 405.1; 312/245, 246; 108/152, 106; 24/590, 591, 592, 593, 594, 595

[56] References Cited

U.S. PATENT DOCUMENTS 3,737,135 6/1973 Bertolini ..... 24/592 X
3,867,742 2/1975 Austin ..... 24/593
3,872,555 3/1975 Link et al. ..... 24/592

FOREIGN PATENT DOCUMENTS 2641648 3/1978 Fed. Rep. of Germany ..... 312/245
3334768 4/1985 Fed. Rep. of Germany ..... 312/245
3409227 9/1985 Fed. Rep. of Germany ..... 312/245

*Primary Examiner*—David L. Talbott
*Assistant Examiner*—Daniel Hulseberg
*Attorney, Agent, or Firm*—Hedman, Gibson, Costigan & Hoare

[57] ABSTRACT

An assembly for wall mounting a cantilevered piece of furniture comprising a first anchoring means suitable for being fastened to a structure such as a wall and a second anchoring means suitable for being fastened to a body such as furniture, stably interconnected. The second anchoring means comprises a housing from which an anchoring member juts out, which ends with a contoured head. The anchoring member is linked to the housing in a freely swinging way and is capable of being rotated and pivoted. The anchoring member can thus be rotated between a first position in which the contoured head can be disengaged from the first attachment means, and a second position in which the contoured head is constrained to the first attachment means. The constraint is held stable by means of a connection between the first and the second anchoring means.

10 Claims, 7 Drawing Sheets

SYSTEM FOR WALL MOUNTING A CANTILEVERING PIECE OF FURNITURE

FIELD OF THE INVENTION

The present invention relates to an improved system for wall mounting a cantilevering piece of furniture, in particular, but not exclusively, a piece of furniture for kitchen fitting.

DESCRIPTION OF THE RELATED ART

European patent application Ser. No. 246,687 relates to a mount arrangement for pieces of furniture in which at least one base piece of furniture, destined to be positioned against a wall, is supported on the floor only by means of a set of legs mounted in its rear region, off barycentre, at a certain distance from said wall, and is fastened to the same wall, in order to prevent it from turning over, by means of freely releasable anchoring means which can be adjusted in position. Said anchoring means comprise adjustable hooking means fastened to the piece of furniture which by means of pegs are constrained, with the possibility of being freely disengaged, to a beam fastened to said wall.

Said beam has a "C"-shaped cross-section, the mutually opposite flanges of which are provided with a plurality of pairs of lined-up bores, suitable for receiving, each of them, one peg passing through the hook of a relevant hooking device.

The invention which constitutes the subject-matter of European patent application Ser. No. 246,687 achieves the purpose of providing a piece of furniture, in particular a piece of furniture for kitchen fitting, has the the same aesthetical appearance as of a wall-hanging piece of furniture, and is capable of withstanding very heavy loads without any problems.

A further achieved purpose is of providing a mount arrangement for pieces of furniture to provide room for the passage of service ducts and cables (water, town-gas, electrical energy).

The general purpose of the present invention is of improving the mount arrangement of European patent application Ser. No. 246,687, to provide ease of mounting and of removal of the piece of furniture, as well as stability and reliability of anchoring to the wall.

SUMMARY OF THE INVENTION

In view of such a purpose, according to the invention, a system for wall mounting a cantilevering piece of furniture is provided, comprising a structural shape suitable for being fastened to the wall and an anchoring device suitable for being fastened to said piece of furniture, and for being stably interconnected with said structural shape, characterized in that said anchoring device comprises of a box-like body from which an anchoring element juts out, ends a shaped head. The anchoring element constrained to said body in a freely swinging way, with the possibility of rotating and translating relative to its own axis through a drive means, so that said anchoring element can be rotated between a first position in which said shaped head can be disengaged from said structural shape, and a second position in which said shaped head is constrained to said structural shape, with said linkage being rendered stable by causing said anchoring element to translate.

The structural and functional characteristics of the present invention and its advantages compared to the prior art will be understood more clearly from the following disclosure, made with reference to the hereto attached schematic drawings. These figures show a system according to an example of a practical embodiment of the same invention.

DESCRIPTION OF THE PREFERRED EMBODIMENT

Figure 1:
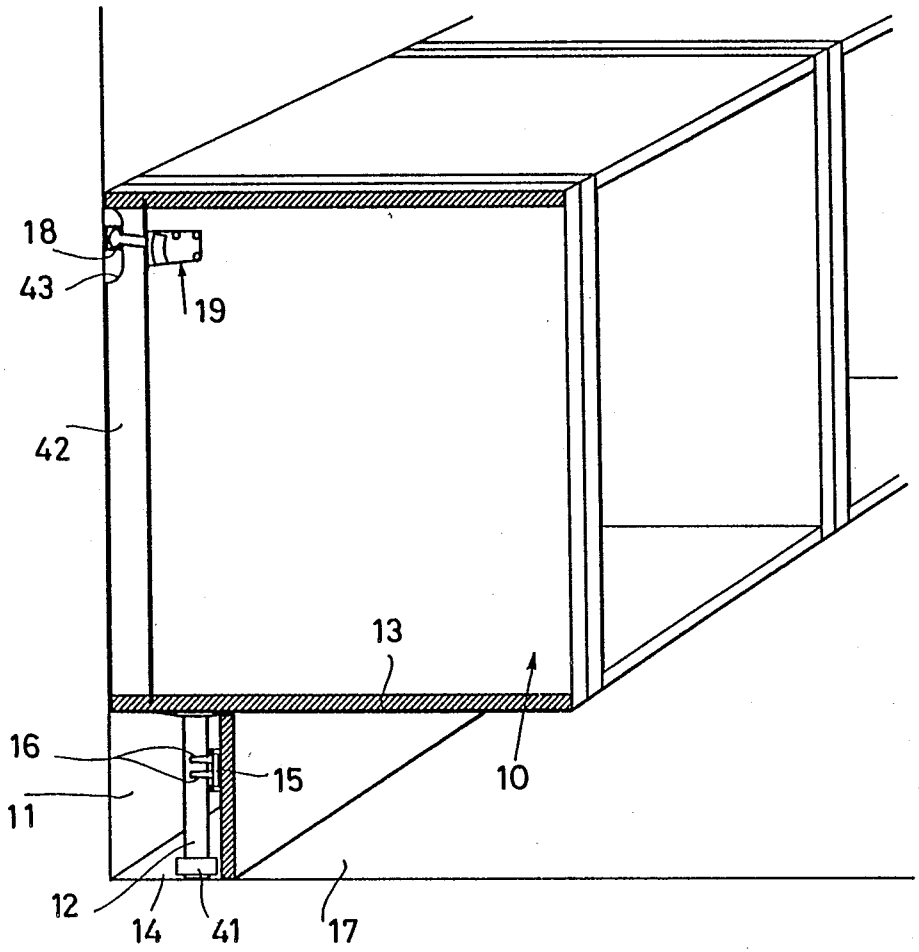
FIG. 1 shows a schematic perspective view of a cantilevering piece of furniture mounted by means of the system according to the present invention.

Referring to the drawings, in particular to FIG. 1, by the reference numeral 10 a base piece of furniture is schematically shown, e.g., a part of a kitchen fitted with modular pieces of furniture. The base piece of furniture is mounted against a wall 11, only resting on a set of rear feet 12 (therefore, off barycentre), fastened onto the bottom 13 of the base piece of furniture in such as position as to define between them and the wall 11 a free chamber 14 suitable for housing service ducts and cable (water, town-gas, electrical energy). The free chamber 14 can be closed by applying to the feet 12 a customary wainscot 15 which is provided, for that purpose, with elements 16 of known type, by means it can be hooked to the same feet 12.

The feet 12 will be such as to secure the base piece of furniture 10 to stably rest on the floor 17, so that such a base piece of furniture is capable of supporting considerable working loads, deriving, e.g., from the application of a worktop, a sink, the containment of heavy things, or of pieces of furniture of column type with built-in electrical household appliances.

The base piece of furniture 10 is prevented from overturning by being anchored to the wall 11 by means of the anchoring system according to the present invention, which comprises, in combination, a perforated bar or beam 18 fastened to the wall 11 in the nearby of the top plane of the same piece of furniture 10, to which beam anchoring devices 19 are constrained. These can be registered in position, and are generally fixed in correspondence of the shoulders of the piece of furniture 10.

Figures 2, 3:
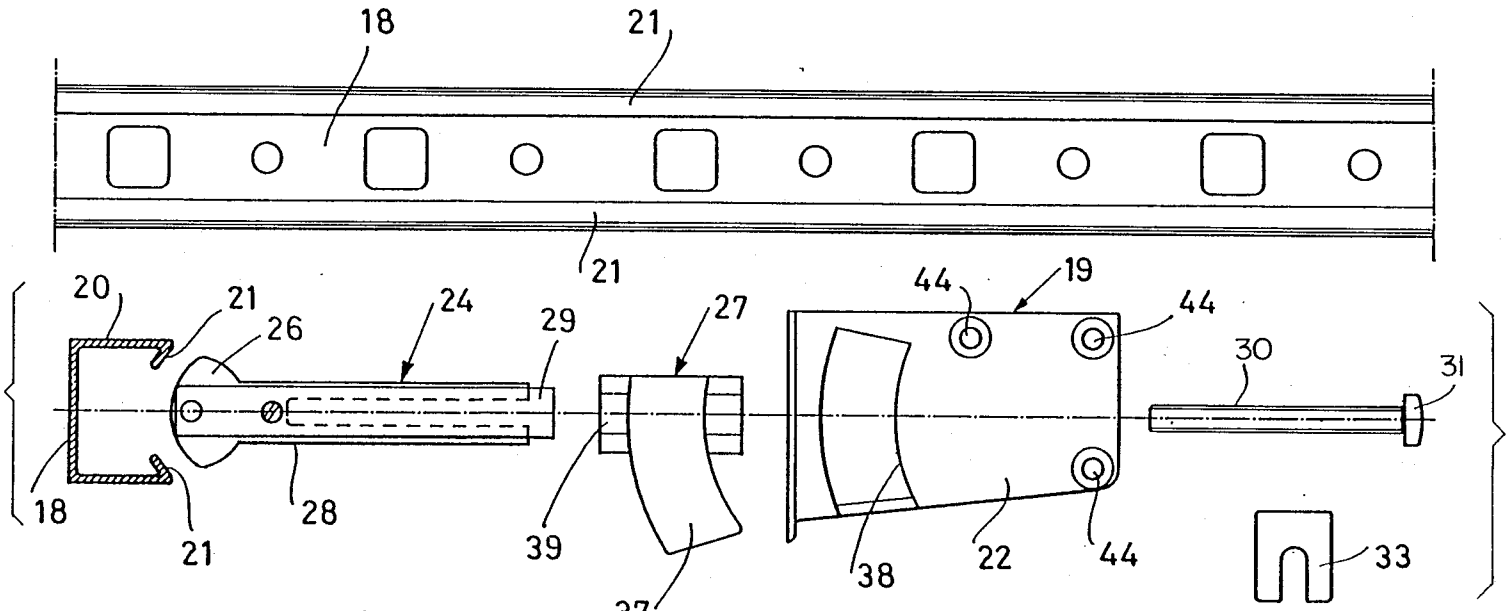
FIG. 2 shows an exploded view illustrating all of the components of the mounting system of FIG. 1.
FIG. 3 shows a front elevation view illustrating the structural shape fastened to the wall, to which the piece of furniture is anchored.

As FIGS. 2 and 3 of the drawings clearly show, the beam 18 has a generally "C"-shaped cross-section, and from its flanges 20 lips 21 jut out. These lips converge towards the interior of the beam; the purpose of said lips 21 will becomes clear from the following.

The anchoring device 19 is structurally formed by a box-like body made from plastic material 22 which has a generally parallelepipedal shape. From a longitudinal side wall of said body, pegs 23 extend for the purpose of achieving a pressure-fastening inside complementary bores provided in the shoulder of the piece of furniture 10.

Said box-like body 22 houses a rod-shaped anchoring element 24, a portion of which juts out from the open front side 25 of the same body 22 and ends with a lobe-shaped head 26.

Figure 15:
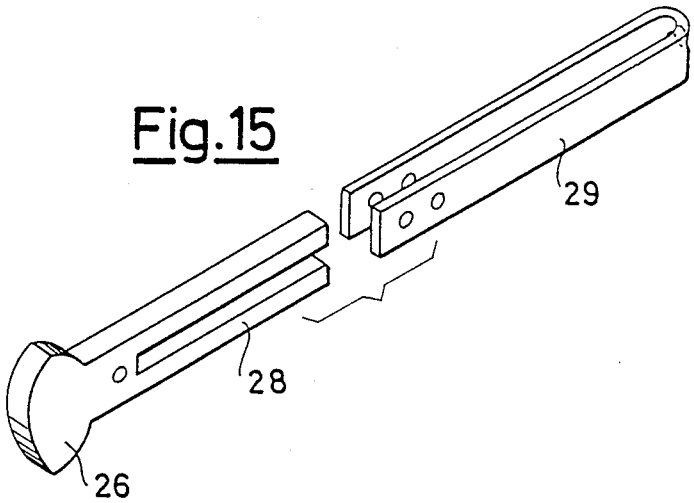
FIG. 15 shows an exploded detail of the anchoring element.

More precisely, the anchoring element 24 is structurally formed by a sleeve 27 through which a rod 28, adjustable in length, runs; for that purpose, the rod 28 is fastened to a fork 29, in different positions (see FIG. 15).

As one can clearly see from the drawings, to the end of the fork 29 opposite to the head end 26, a screw 30 is screwed down, the head 31 of which is loosely housed inside a suitable seat 32 provided inside the box-like body 22 and is constrained inside said seat by means of a "U"-piece 33 which enters purposely provided guide slots 40.

Figure 7:
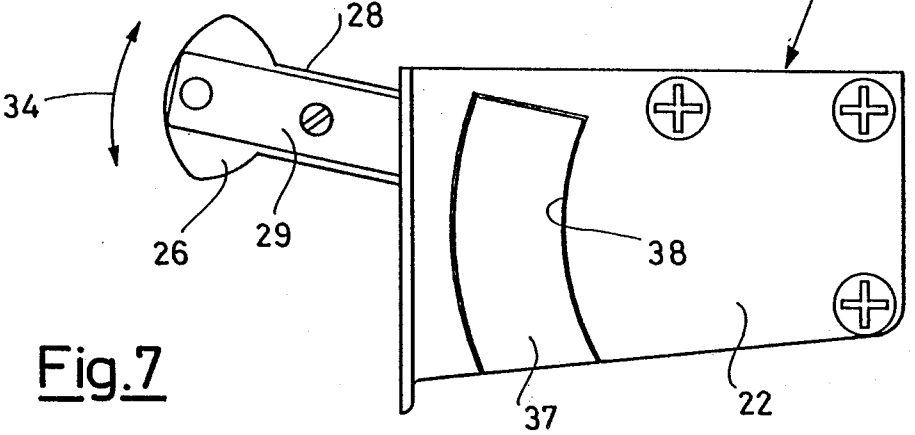
FIG. 7 shows a view according to arrow F1 of FIG. 6.
Figure 8:
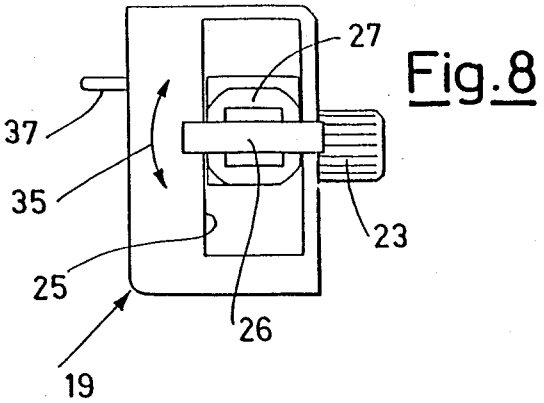
FIG. 8 shows a view according to arrow F2 of FIG. 5.
Figure 9:
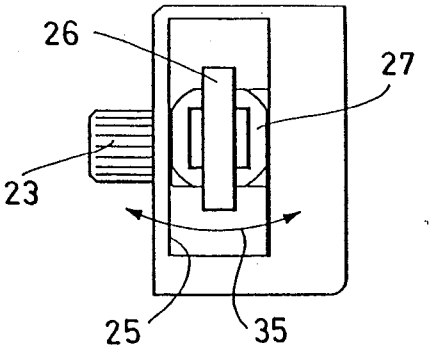
FIG. 9 shows a view according to arrow F3 of FIG. 6.
Figure 12:
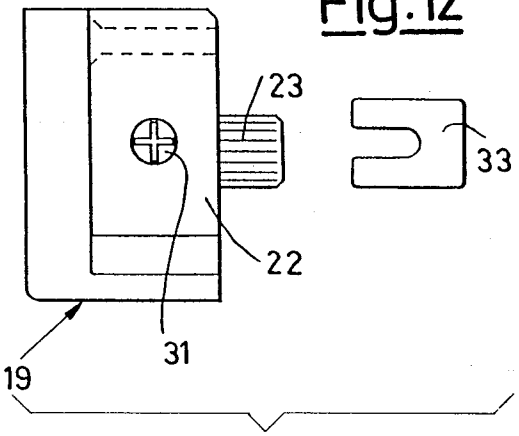
FIG. 12 shows a sectional view according to arrow F4 of FIG. 10, in which the screw anchoring "U"-shaped piece is shown spaced apart.
Figure 10:
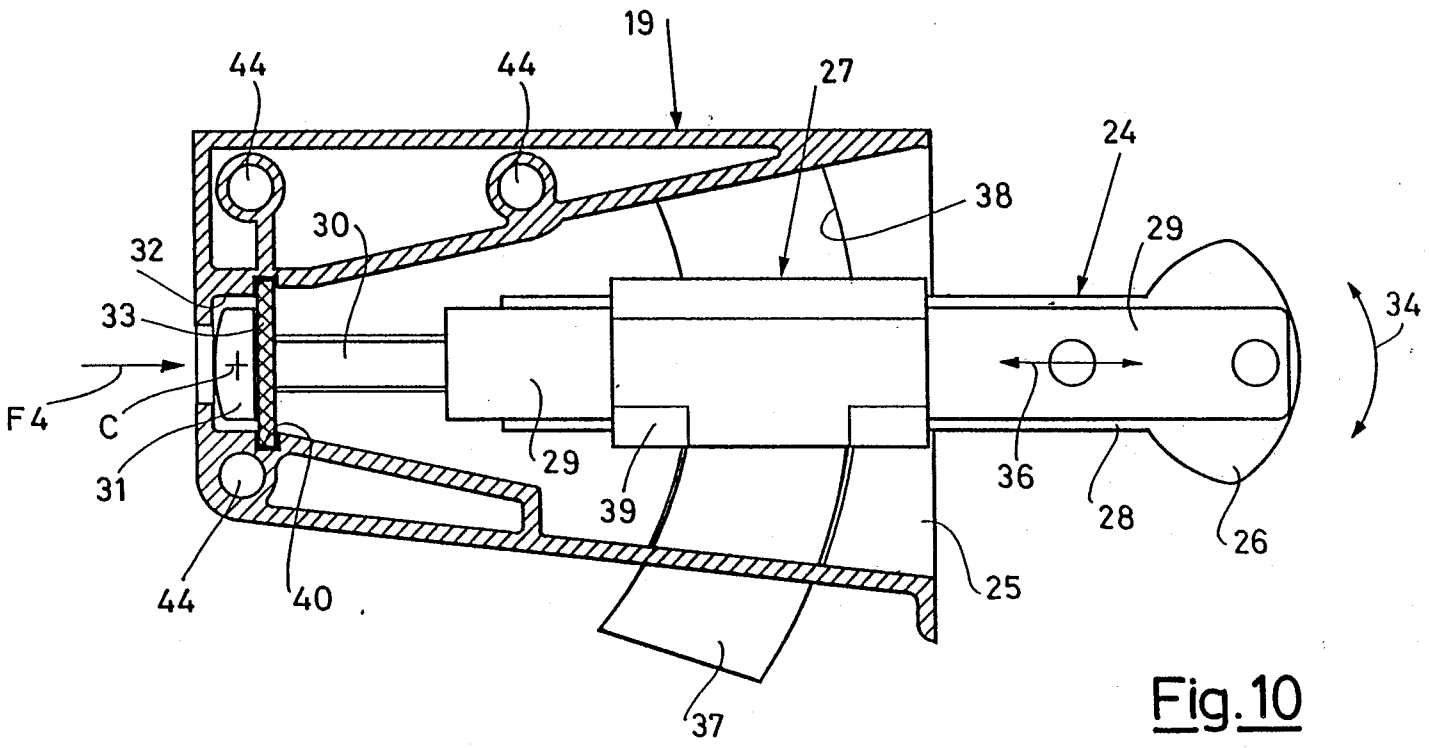
FIG. 10 shows a sectional view of the anchoring device.

In such a way, the head 31 of the screw constitutes an articulation member for the anchoring element 24, which can both swing in the directions as shown by arrow 34 (FIGS. 7, 10 and 11), and rotate around its own axis in the directions as indicated by the arrow 35, between the two positions as shown in FIGS. 8 and 9. Furthermore, by acting on the screw 30, the anchoring element 24 can be also driven to translate in the directions as indicated by the arrow 36 (FIG. 10).

Figure 11:
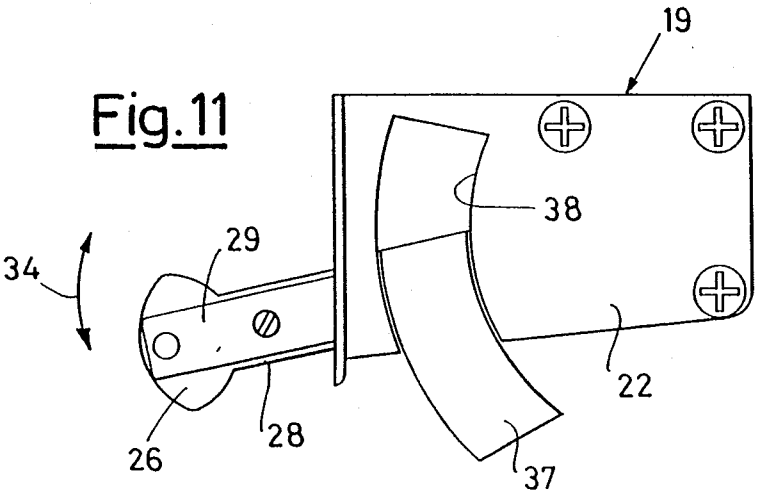
FIG. 11 shows the same view as of FIG. 7, but showing the anchoring element in a different operating position, as a function of the height of leveling of the piece of furniture.

The rotation of the anchoring element 24 between the two positions as shown in FIGS. 8 and 9 is driven by means of a tang 37 integral with the sleeve 27. As one can clearly see from the drawings, said tang 37 extends radially from the sleeve 27 and is suitable for passing through an arcuate slot 38 provided in the box-like body 22. More precisely, when the anchoring element 24 is in its non-operating position (not in its hooking position) shown in FIGS. 4, 5 and 8, the tang 37 extends outwards from the box-like body 22, passing through the arcuate slot 38; when, on the contrary, the anchoring element 24 is in its operating position as shown in FIGS. 7, 9 and 11, the tang 37 is partially or totally contained inside the same complementary arcuate slot 38, anyway coplanar with the wall of the box-like body 22. As a consequence, in both said positions of the anchoring element 24, the sleeve 27 is constrained to the box-like body 22 as regards the translation, but not as regards the rotation. In other terms, the anchoring element 24 and the sleeve 27 are integral with each other as regards their swinging around the theoretical centre "C" in the directions as shown by the arrow 34 and as regards their rotation around their own axis in the directions as shown by the arrow 35, but not as regards the translation: in fact, the anchoring element 24 driven by the screw 30 can freely translate in the directions as shown by the arrow 36 by sliding inside the interior Of the sleeve 27.

One should finally observe that the sleeve 27 has a cross-section of polygonal shape with rounded edges, so that its sides 39 cooperate with the inner walls of the box-like body 22 in order to positively determine the two positions as depicted in FIGS. 8 and 9; such positions are spring-wise determined thanks to the characteristics of elastic yielding of the opposite walls of the box-like body 22, preferably made from plastic material.

The operating way of the mount system according to the present invention clearly appears from the above with reference to the figures, and, is as follows.

Figure 4:
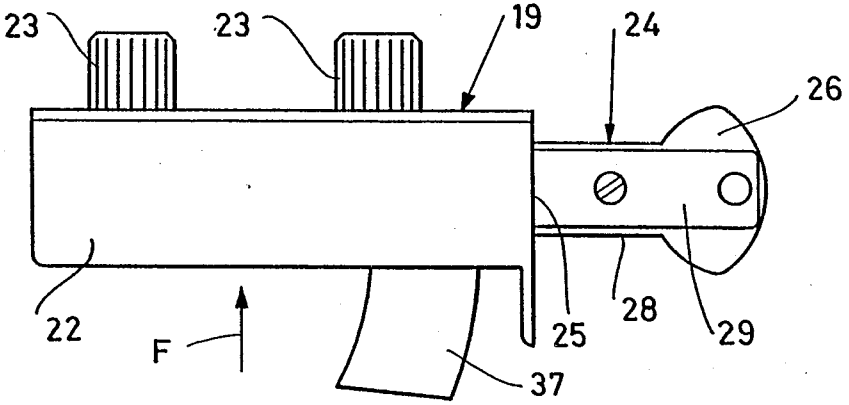
FIG. 4 shows a plan view illustrating the anchoring device in its non-operating position, in which the anchoring element can be inserted between the flanges of the structural shape of FIG. 3.
Figure 5:
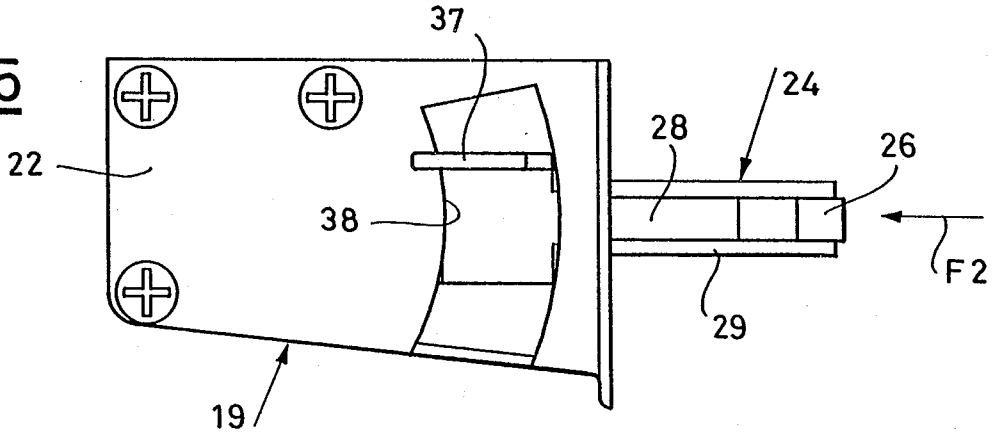
FIG. 5 shows a view according to the arrow F of FIG. 4.
Figure 6:
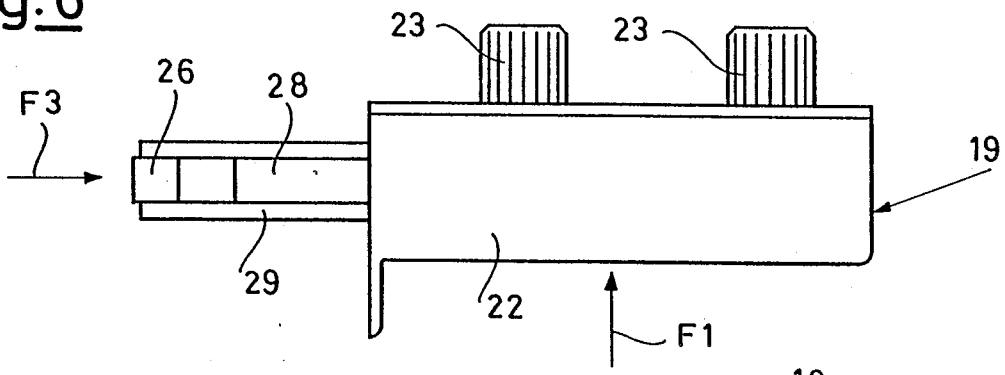
FIG. 6 shows the same plan view as of FIG. 4, but illustrating the anchoring device in its operating position in which the anchoring element is inserted and locked between the flanges of the structural shape of FIG. 3.
Figure 13:
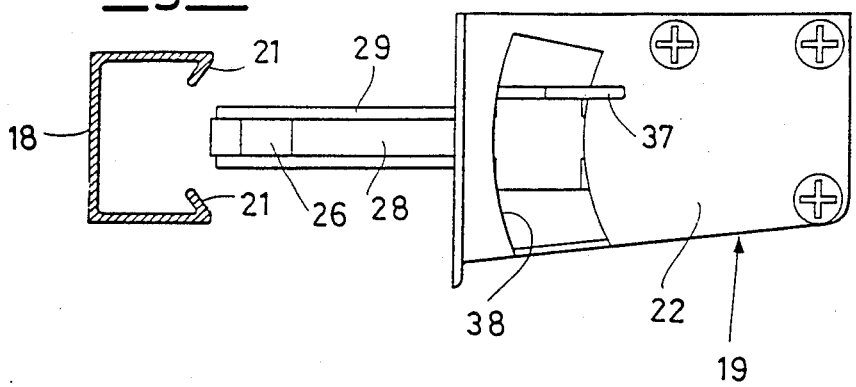
FIG. 13 shows a magnified detail, illustrating the mounting system of the invention is a non-operating position thereof.
Figure 14:
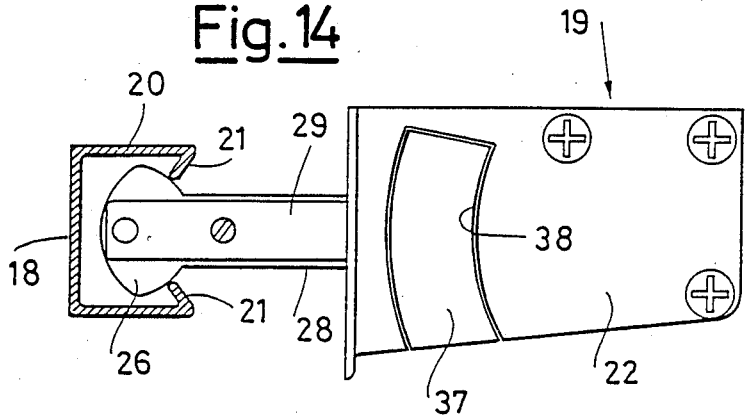
FIG. 14 shows the same view as of FIG. 13, but illustrating the mounting system of the invention in the operating position thereof.

The piece of furniture 10, resting on its feet 12 (with said feet being preferably provided with a plate 41 of adequate size) and provided with a plurality of devices 19, is approached to the wall 11 on which the beam 18 is already fixed (by means of screw anchors and/or screws), at a height approximately corresponding to the height of the devices 19. During this mounting stage, the devices 19 are prearranged with the anchoring element 24 being in its non-operating position as shown in FIGS. 4, 5 and 8, so that the head 26 can be inserted into the interior of the structural shape 18 in the position as shown in FIG. 13.

To that end, through the side wall 42 of the piece of furniture, a slot 43 can be provided in advance. Now, it is just necessary to rotate, by means of the tang 37, the anchoring element 24 into its vertical operating condition as shown in FIGS. 7, 9, 10, 11 and 14, in order to prevent the head 26 from being prone to be slid out from the lips 21 of the structural shape 18.

Then, by acting on the tie-screw 30, the piece of furniture 10 is perfectly aligned to the wall 11, thus securing a perfect stability of the same piece of furniture 10.

Finally, by acting on the feet adjustable in height 12, a perfect levelling of the piece of furniture 10 can be achieved thanks to the anchoring element 24, which by freely swinging around the point "C" perfectly matches the new end position of the piece of furniture. Achieving this result is also made possible by the purposely provided lobe-shaped contour of the head 26, which secures uniform oscillations with anchorage to take place in each position relatively to the beam 18.

Whenever so desired, by simply moving the anchoring element 24 back into its position as shown in FIG. 13, and causing the sleeve 27 to trip—in this position—by acting on the tang 37—which tang 37 is accessible from the interior of the piece of furniture 10—, the same piece of furniture can be removed from the wall 11.

One should observe that the length of the anchoring element 24 can be adjusted in advance as a function of the distance of the device 19 from the wall 11.

Of course, the system according to the present invention can be applied as well to pieces of furniture of column type or of any other types, however without departing from the scope of the same invention.

One should finally observe that the fastening of the anchoring device to the piece of furniture also can be achieved by means of additional screws besides the pegs 23, or by means of screws only; for that end, in the box-like body 22, seats 44 are provided.

Furthermore, the system according to the present invention could be practiced as well without the sleeve 27 and the relevant drive tang 37.

In fact, the functions of translation and rotation of the anchoring element respectively performed by the screw 30 and by the tang 37 might be combined in one single drive means.

Thus, the purpose stated in the foreword to the disclosure is achieved.

I claim:

1. The language "shaped head end outside said housing and an end within and connected to said housing for pivotal and rotational movement of said anchoring member to allow for adjustments between said anchoring means and for rotation of said shaped head end from a first position which can move within said first anchoring means to a second position adapted to engage said first anchoring means for securing said second anchoring means thereto" has been deleted and the language—longitudinal axis, a shaped head end extending outside said housing and a connecting end within said housing, said connecting end permitting both pivotal movement of said anchoring member to allow for adjustments between said first and second anchoring means, and rotational movement of said anchoring member about said longitudinal axis between a first rotated position, wherein said shaped head end can be freely inserted into said first anchoring means, and a second rotated position, wherein said shaped head end is adapted to engage said first anchoring means so as to prevent removal of said second engaging means when said shaped head end is inserted into said first engaging means—has been inserted therefor;

2. The assembly of claim 1, wherein said first anchoring means has a substantially "C" shaped cross section and further includes lips which converge towards the convexity of said "C" shaped cross section for engaging said shaped head end in said second position of said anchoring means.

3. The assembly of claim 1, wherein said housing of said second anchoring means is a box-like body having a first end for connecting said anchoring member thereto and a second opposing end which is open and through which said anchoring member extends.

4. The assembly of claim 3, wherein said housing includes a recess in said first end, and wherein said connecting end of said anchoring member includes an attachment means in said recess for connecting said anchoring member within said housing.

5. The assembly of claim 4, wherein said anchoring member includes a U-shaped element which is adjustably connected to said attachment means for varying the length of said anchoring member.

6. The assembly of claim 5, wherein said anchoring member includes an anchoring element having a first end including said shaped head end and a depending portion connected to said U-shaped element, and wherein said anchoring element is adapted to extend from said housing to said first anchoring member.

7. The assembly of claim 6, wherein said anchoring member includes a sleeve through which said anchoring and U-shaped element extend.

8. The assembly of claim 7, wherein said sleeve cooperates with walls of said box-like body of said housing for maintaining said member in its first and second positions.

9. The assembly of claim 8, wherein said housing has a slot extending through a wall thereof, and said sleeve comprises a tang laterally extending through said slot for rotation and pivotal adjustments of said anchoring member.

10. The assembly of claim 9, wherein said shaped head end has a substantially lobe-shaped contour.

* * * * *